US007004600B2

(12) United States Patent
Echterling

(10) Patent No.: US 7,004,600 B2
(45) Date of Patent: Feb. 28, 2006

(54) FLASHLIGHT ADAPTER

(76) Inventor: Kevin B. Echterling, 1925 N. 325 E., LaGrange, IN (US) 46761

( * ) Notice: Subject to any disclaimer, the term of this patent is extended or adjusted under 35 U.S.C. 154(b) by 84 days.

(21) Appl. No.: 10/454,412

(22) Filed: Jun. 4, 2003

(65) Prior Publication Data

US 2003/0231490 A1 Dec. 18, 2003

Related U.S. Application Data

(60) Provisional application No. 60/388,050, filed on Jun. 12, 2002, provisional application No. 60/429,726, filed on Nov. 27, 2002.

(51) Int. Cl.
*F21L 4/00* (2006.01)

(52) U.S. Cl. ..... 362/187; 362/202; 362/208

(58) Field of Classification Search ..... 362/186–187, 362/331, 268, 208, 455
See application file for complete search history.

(56) References Cited

U.S. PATENT DOCUMENTS

| | | | | |
|---|---|---|---|---|
| 2,309,687 A | | 2/1943 | Wood | |
| 3,020,396 A | * | 2/1962 | Worboys | 362/331 |
| 3,114,143 A | | 12/1963 | Robinson | |
| 3,258,589 A | | 6/1966 | Doring | |
| 3,368,069 A | | 2/1968 | Trott | |
| 3,904,867 A | | 9/1975 | Salem | |
| 4,225,907 A | | 9/1980 | Erdell | |
| 4,280,170 A | * | 7/1981 | Baldwin | 362/224 |
| 4,782,433 A | | 11/1988 | Rombough | |
| 5,001,612 A | | 3/1991 | Odlum | |
| 5,165,782 A | | 11/1992 | Maglica et al. | |
| 5,267,131 A | | 11/1993 | Anthony et al. | |
| 5,519,593 A | | 5/1996 | Hasness | |
| 5,895,111 A | * | 4/1999 | Santosuosso et al. | 362/125 |
| 5,988,833 A | * | 11/1999 | Giese et al. | 362/287 |
| 6,761,467 B1 | * | 7/2004 | Matthews et al. | 362/202 |

OTHER PUBLICATIONS

Maglite® Web Catalog, Maglite® Flashlight Accessories, D-Cell Accessory Pack, Mag Instrument, Inc., Ontario, Canada, May 19, 2003, 1 page. http://www.maglite.com/product_acc.sap?id=374593475757554&plc+DCELL&psc=5DC . . . .

Maglite® Web Catalog, Tactical Accessories, Mag Instrument, Inc., Ontario, Canada, May 19, 2003, 1 page. http://www.maglite.com/publicsafety_tactical.asp.

* cited by examiner

*Primary Examiner*—Ali Alavi
(74) *Attorney, Agent, or Firm*—Barnes & Thornburg LLP

(57) ABSTRACT

A flashlight adapter is provided having a cap and a light diffusing lens. The cap is selectively attachable to and removable from a flashlight. The light diffusing lens is affixed to the cap and is located adjacent the flashlight's light source. The light from the light source is emitted through the light diffusing lens to clarify an illuminated object.

12 Claims, 3 Drawing Sheets

FIG. 3
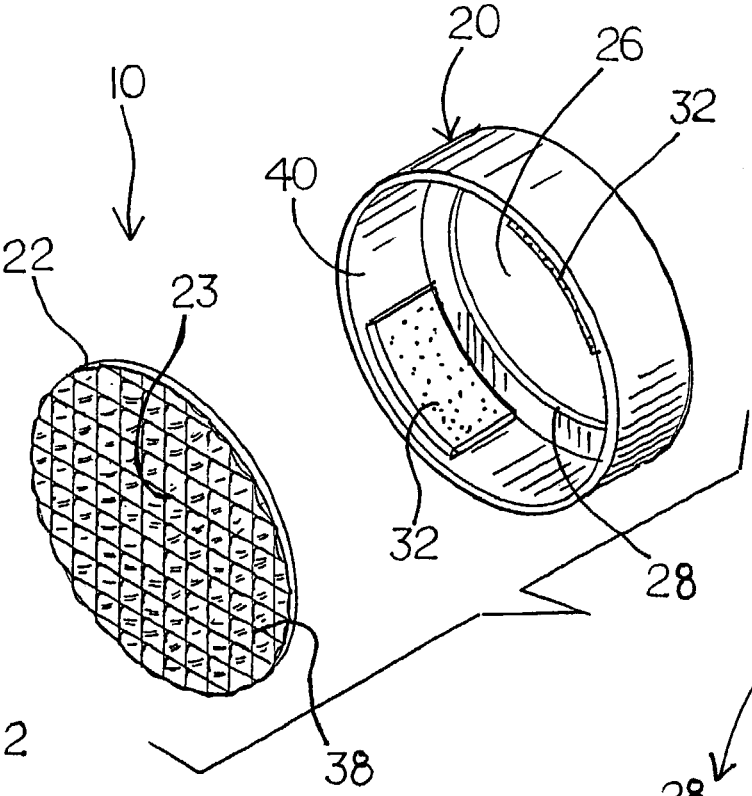
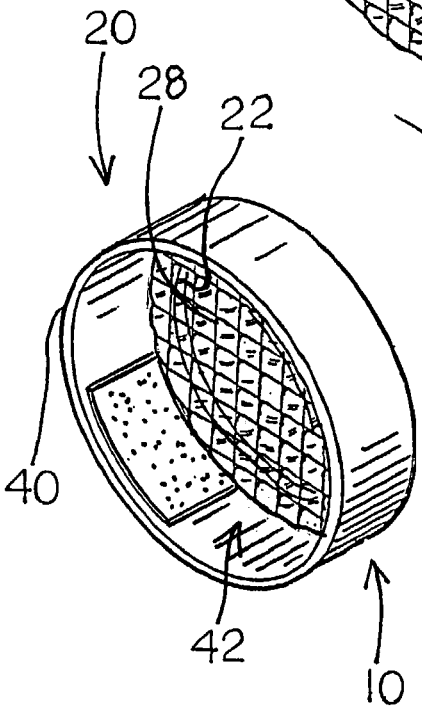
FIG. 4
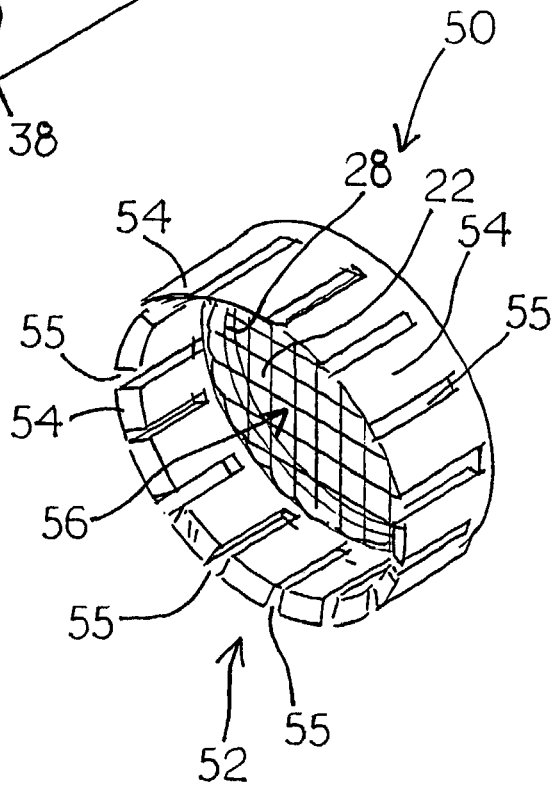
FIG. 5

FIG. 6
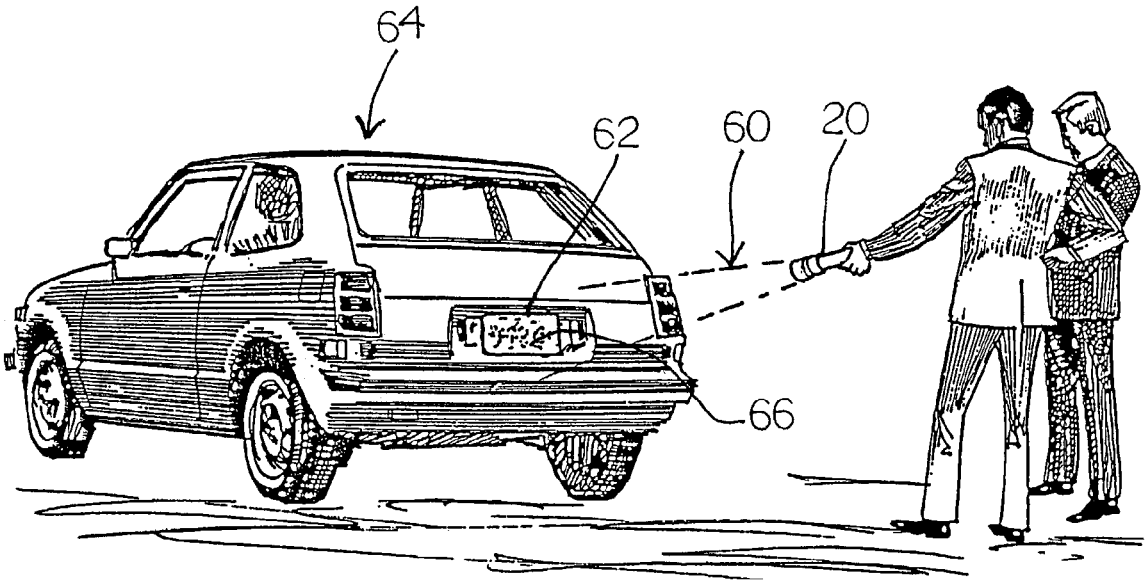
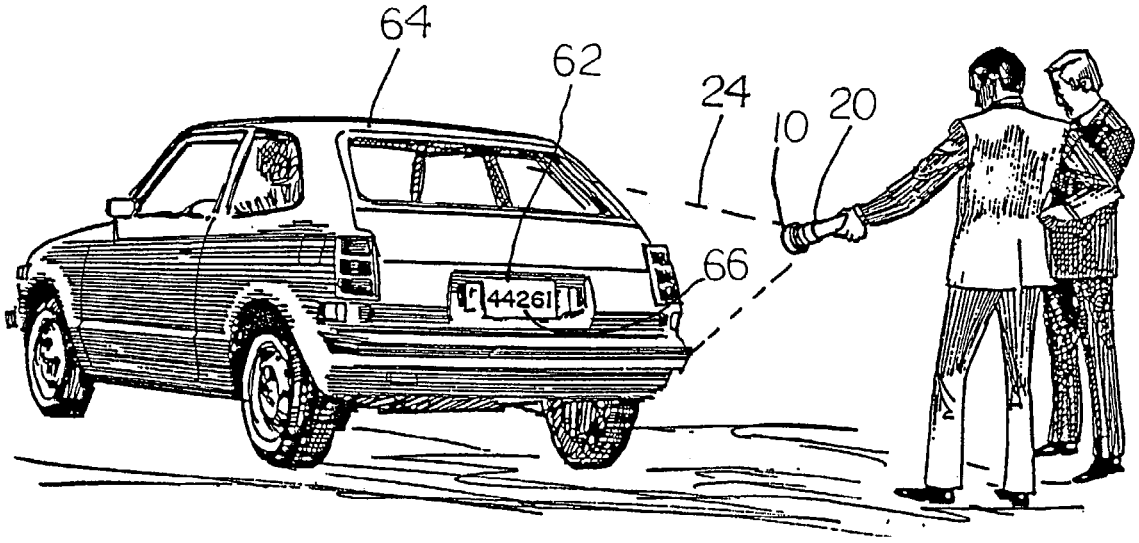
FIG. 7

FLASHLIGHT ADAPTER

RELATED APPLICATIONS

The present application is related to and claims priority to U.S. Provisional Patent Application, Ser. No. 60/388,050, filed on Jun. 12, 2002, entitled "Flashlight Adapter" and to U.S. Provisional Patent Application, Ser. No. 60/429,726, filed on Nov. 27, 2002, entitled "Flashlight Adapter." The subject matter disclosed in those applications are hereby expressly incorporated into the present application.

TECHNICAL FIELD

The present invention relates to flashlights, and more particularly to an accessory that attaches to the flashlight to change the character of the light emitted therefrom.

BACKGROUND AND SUMMARY

Flashlights, including searchlights, lanterns, and other portable lighting devices, are well known in the art. Typically, such devices are battery-powered lamps often having a reflector to emit light in a particular direction or directions.

A common use for flashlights is in police-work. Whether identifying persons or objects in low light conditions, the flashlight is so utilitarian that it has become standard issue for most police officers. A typical flashlight used in police-work is the Maglite® flashlight, though any type of flashlight, searchlight, lantern, or the like is contemplated to be within the scope herein and will be collectively referred to as "flashlight."

One use of the flashlight for police-work is lighting potential evidence at a crime scene at night or in otherwise low light conditions. And as is often standard procedure, such potential evidence is photographed at the scene. Flashlights used by officers, detectives, and/or crime-scene investigators tend to be powerful and use a conventional lens known to those skilled in the art. As a result, the light emitted from the flashlight is often bright and uneven. And, though the power of the flashlight is very useful to illuminate persons and objects in low light conditions for identification purposes, the unevenness in light distribution tends to make it ill-suited to illuminate objects that are going to be photographed. This is particularly the case with digital cameras, which are becoming a more important tool for detectives. The bright, uneven beam makes it very difficult to photograph an object with any level of detail, because of high contrast or glaring that can occur. Relevant detail might become lost or otherwise virtually unreadable to a camera.

It is known by those skilled in the art, however, that lights which produce a more diffused beam of light can suit such photography needs much better. Light, particularly bright light, can be softened when it passes through a lens, particularly a textured, or otherwise filtered lens that diffuses the light to reduce glare and sharp contrasts on an object.

With flashlights being so utilitarian in police-work, however, often working fine for most applications, there may be resistance giving up the power provided by presently constructed flashlights in favor of a more diffuse-even beam just to take photographs. This is especially the case since lighting objects for taking photographs is only one of the several uses of the flashlight. Furthermore, other attachments or devices exist for flashlights that use colored lens for signaling, directing traffic, or night viewing, etc. The devices, however, do not solve the problem assisting in crime scene photography, or the like.

It would, thus, be beneficial to provide an adapter that can be easily attached to a conventional flashlight and produce the desired diffused light beam when low-level light conditions exist, and then be removed so the flashlight can be used for other tasks or receive other attachments.

Accordingly, the following disclosure provides, in various illustrative embodiments, a flashlight having a body, a light source located adjacent one end of the body, and a lens attached to the body through which light from the light source is emitted. The flashlight also has an adapter. The adapter comprises a cap and a second lens. The cap is selectively attachable to and removable from the flashlight's body. The cap is also located adjacent to the lens. The second lens is affixed to the cap and is located adjacent and substantially parallel to the lens attached to the body. The light from the light source is emitted through the second lens. In addition, the second lens is a light diffusing lens.

In the above-described and other embodiments, the flashlight may comprise: an end cap that is attachable to the body of the flashlight, wherein a lens is attached to the end cap and wherein a cap of the adapter is selectively attachable to and removable from the end cap; a cap of the adapter comprising a friction member to selectively attach and remove the cap from the flashlight's body; a cap comprising a bias member to selectively attach and remove the cap from the flashlight's body; a cap comprising a means to selectively attach and remove the same from the flashlight's body; a second lens having a prismatic surface; and a second lens being a disc having a surface suitable for diffusing light.

Another illustrative embodiment provides a flashlight adapter which comprises a cap and a light diffusing lens. The cap is selectively attachable to and removable from a flashlight. The light diffusing lens is affixed to the cap and is located adjacent the flashlight's light source and lens. The light from the light source is emitted through the light diffusing lens to clarify an illuminated object.

In the above-described and other embodiments, the flashlight adapter may comprise: a light diffusing lens being a disc and having a surface suitable for diffusing light; a cap comprising bias members to selectively attach and remove the cap from the flashlight; a light diffusing lens covering a flashlight lens which is attached to the flashlight; a diffusing lens having a textured surface; a cap comprising a pad that removably secures the cap to the flashlight; and the light diffusing lens having a prismatic surface.

Another illustrative embodiment provides a flashlight having a body, a reflector located adjacent one end of the body, a light source adjacent the reflector, a lens attached to the body and through which light from the light source is emitted, and an adapter. The adapter comprises a means for selectively attaching and removing the adapter from the flashlight. The adapter also comprises a means for diffusing light emitted from the flashlight to clarify an illuminated object. In addition, the means for diffusing light is attached to the means for selectively attaching and removing the adapter from the flashlight. The flashlight adapter may also comprise a means for selectively attaching and removing the adapter from the flashlight which comprises an attaching means to secure the adapter to the flashlight.

Additional features and advantages of the adapter will become apparent to those skilled in the art upon consideration of the following detailed description of the illustrated embodiment exemplifying the best mode of carrying out the adapter as presently perceived.

BRIEF DESCRIPTION OF DRAWINGS

The present disclosure will be described hereafter with reference to the attached drawings which are given as non-limiting examples only, in which:

FIG. 3 is an exploded perspective view of the illustrative adapter of FIG. 1;

FIG. 4 is an assembled perspective view of the illustrative adapter of FIG. 1;

FIG. 5 is an assembled perspective view of another illustrative embodiment of an adapter;

FIG. 6 is a demonstrative view of the resulting illumination of the flashlight prior the employ of the adaptor of either FIG. 4 or 5; and FIG. 7 is a demonstrative view of the resulting illumination of the flashlight during the employ of the adaptor of either FIG. 4 or 5.

Corresponding reference characters indicate corresponding parts throughout the several views. The exemplification set out herein illustrates embodiments of the adapter, and such exemplification is not to be construed as limiting the scope of the adapter, in any manner.

DETAILED DESCRIPTION OF THE DRAWINGS

Figure 1:
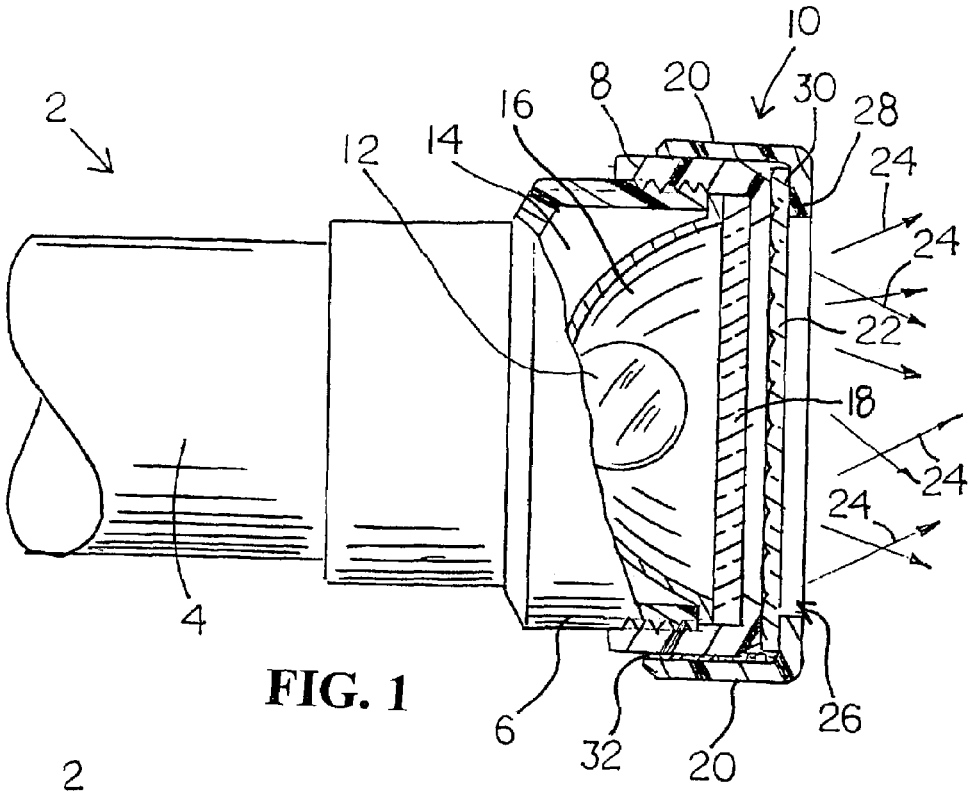
FIG. 1 is a partially cross-sectioned detailed side view of an illustrative flashlight having one illustrative embodiment of the adapter attached thereto.

A partially cross-sectioned detailed side view of an illustrative flashlight 2 is shown in FIG. 1. The illustrative flashlight 2 comprises a body 4 having a shoulder 6 extending from one end and a cap 8 shrouding the shoulder 6. Flashlight 2 also comprises an adapter 10 that shrouds cap 8 as shown. Illustratively, a light bulb 12 is located within a cavity 14 of shoulder 6. The light bulb 12 is powered by a power source (not shown) which may be batteries, or a power cord, for example. A reflector 16 partially surrounds light bulb 12 to assist in directing light emitted from light bulb 12 through flashlight lens 18. In addition, the light directed through lens 18 is also being directed through a lens 22 that is attached to a cap 20 of adapter 10. In the illustrated embodiment, it is contemplated that lens 22 is a lens that will diffuse light beam 24 as shown. The diffused light is softened so that objects illuminated thereby will become clear, particularly to a camera lens. Illustratively, the light is diffused by passing through the prismatic surface 23. The prismatic surface 23 comprises a plurality of hexagonally-shaped surfaces that redirect light passing therethrough, producing the diffused light beam 24. It is appreciated, however, that the texture of the surface of lens 22, or its composition, can vary, or the lens have a prismatic character, or otherwise produce the diffused light beam 24.

In the illustrative embodiment, a bore 26 is disposed through adapter cap 20 so that light from light bulb 12 exits bore 26 as shown by beams 24. Also in this illustrative embodiment, lens 22 is attached to a periphery portion 28 of cap 20 creating an attachment point 30 between the two structures. Cap 20, in the illustrative embodiment, is secured to cap 18 as shown by a wedge pad 32. In this embodiment, pad 32 is compressed when cap 20 is fitted over cap 8, creating an interference fit therebetween to removably secure cap 20 to flashlight 2. It is appreciated, however, that the attachment means, selective or otherwise, of cap 20 to cap 8, can be of any variety so as to attach to any analogous flashlight structure. For example, the attachment means could be by pressure or a bias member, threads, magnetism, etc. This way cap 20 can either be attached to flashlight 2 or removed therefrom without affecting any other structure of the flashlight 2 or affecting its ability to perform its function.

Figure 2:
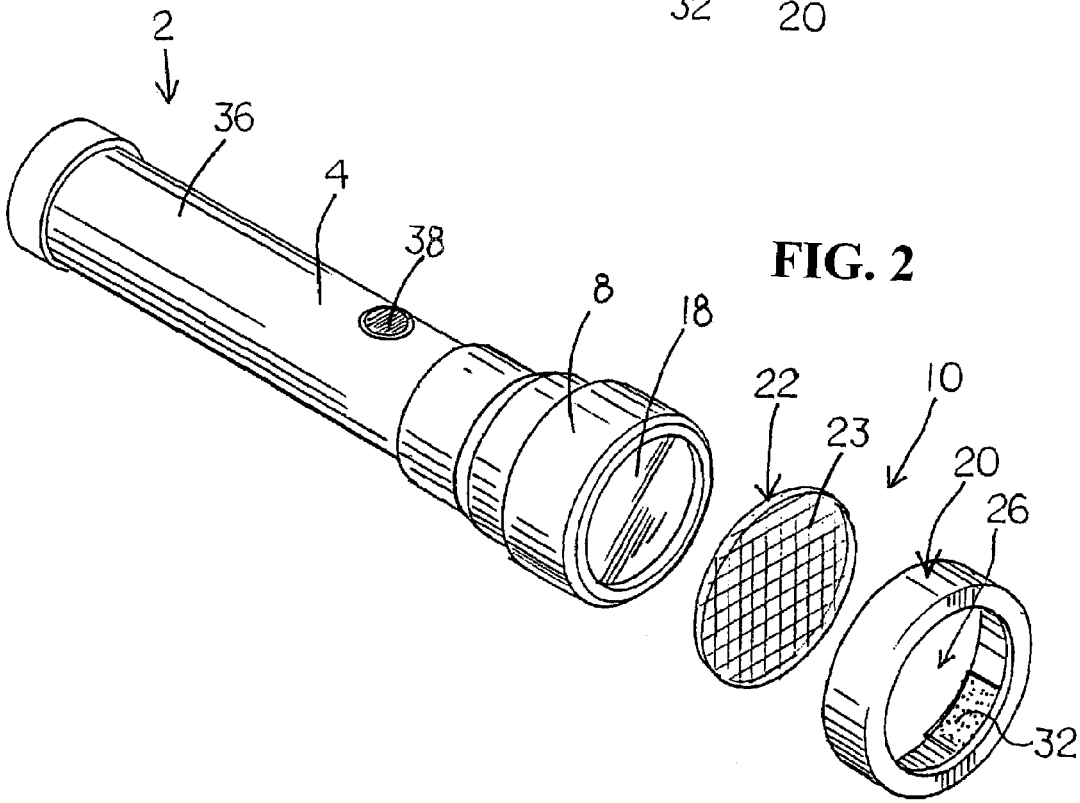
FIG. 2 is an exploded perspective view of the flashlight and components of the illustrative adapter of FIG. 1.

An exploded perspective view of flashlight 2 and adapter 10 is shown in FIG. 2. The flashlight 2 shown is, again, of conventional design having a gripper portion 36 of body 4 and a power switch 38 thereon as well. The adapter 10 shown in FIG. 2 includes the lens 22 and cap 20. Clearly shown is the positional relationship between lens 22 of adapter 10 and lens 18 of flashlight 2. Illustratively, lens 22 is fastened to cap 20 via an adhesive, ultrasonic welding, a fastener, etc. The light emitted from the lens 18 passes through lens 22 and out aperture or bore 26. Also shown in FIG. 2 is wedge pad 32 as the illustrative means for creating the interference fit to removably secure adapter 10 to, in this case, cap 8 of flashlight 2.

An exploded perspective view of adapter 10 at a reverse angle from that shown in FIG. 2 is shown in FIG. 3. The cap 20 shows aperture 26 along with the periphery 28 located about aperture 26. Illustratively, lens 22 is attached to this periphery via an adhesive, ultrasonic welding or a fastener, for example. It is contemplated that periphery 28 can be alternatively configured to receive lens 22 without departing from the scope of the disclosure herein. Pads 32 are shown located on a flange portion 40 of cap 20.

An assembled perspective view of adapter 10 is shown in FIG. 4. This view shows the illustrative attachment of lens 22 to periphery 28. In addition, flange portion 40 forms a cavity 42 which receives the lens cap 8 of flashlight 2.

Another illustrative embodiment of a flashlight adapter 50 is shown in FIG. 5. Flashlight adapter 50 comprises a lens 22 attached to periphery 28. A distinction from adapter 10, however, is that the flange portion 52 of adapter 50 is of different character than the flange portion 52 shown in FIG. 4. In this illustrative embodiment, flange adapter 50 comprises fingers 54 that are configured to have a bias directed inwards toward cavity 56. The fingers 54 illustratively have spaces 55 located therebetween. When this illustrative adapter 50 fits onto the lens cap of a flashlight, the fingers are configured to bias against the lens cap to assist in securing adapter 50 thereto. The diameter of the cavity can be slightly less than the diameter of the lens cap to produce the bias against same.

A demonstrative view of the illumination from a flashlight 2 is shown in FIGS. 6 and 7. Specifically, shown in FIG. 6 is the resulting illumination from a flashlight 2 that does not include either adapters 10 or 50. In this first view, the beam 60, illustratively shining on a license plate 62 of a vehicle 64, makes it difficult to read the indicia 66 that is displayed on license plate 62. The indicia 66 is obscured by glaring from the strength and unevenness of the light beam. This is particularly the case with a camera where, even though the human eye may be able to see the indicia 66 on a license plate 62 clearly enough, the bright beam from the flashlight may cause too much glare that a camera may not be able to photograph it properly. This is in contrast to flashlight 2 in FIG. 7 that has either adapter 10 or 50 attached thereto, where beam 24, as also shown in FIG. 1, illuminates license plate 62 of vehicle 64. In this case, the indicia 66, which, for example, are license plate numbers, are clearly shown to such a device as a camera.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A flashlight having a body, a light source located adjacent one end of the body, a lens attached to an end cap and through which light from the light source is emitted, wherein the end cap is attachable to the body adjacent the light source, and an adapter, the adapter comprising:

a cap that is selectively attachable to and removable from the end cap, and is located adjacent to the lens;

wherein the cap has a periphery that is formed about the circumference of one edge of the cap; and a second lens bounded by the cap and the periphery, and located adjacent and substantially parallel to the lens attached to the body;

wherein light from the light source is emitted through the second lens; and wherein the second lens is a light diffusing lens.

2. The flashlight of claim 1, where the cap further comprises a plurality of spaced-apart fingers that engage the end cap to selectively hold the adaptor onto the flashlight.

3. The flashlight of claim 1, wherein the cap of the adapter further comprises a friction member to selectively attach and remove the cap from the flashlight's body.

4. The flashlight of claim 1, wherein the cap further comprises a bias member to selectively attach and remove the cap from the flashlight's body.

5. The flashlight of claim 1, wherein the cap further comprises a means to selectively attach and remove the same from the flashlight's body.

6. The flashlight of claim 1, wherein the second lens has a prismatic surface for diffusing light passing therethrough.

7. The flashlight of claim 1, wherein the second lens is a disc having a surface suitable for diffusing light.

8. A flashlight adapter comprising:

a cap having a unitary band is selectively attachable to and removable from a flashlight;

wherein the unitary band of the cap has an interior surface that faces the flashlight when attached thereto;

a wedge configured to be positioned between the interior surface of the band and the flashlight to hold the cap on the flashlight; and a light diffusing lens affixed to the cap and is located adjacent the flashlight's light source and lens;

wherein light from the light source is emitted through the light diffusing lens having a surface suitable for diffusing light.

9. The flashlight adapter of claim 8 wherein the wedge assists to removably secure the cap to the flashlight.

10. The flashlight adapter of claim 8, wherein the light diffusing lens has a prismatic surface.

11. The flashlight adapter of claim 8, wherein the light diffusing lens covers a flashlight lens which is attached to the flashlight.

12. The flashlight adapter of claim 8, wherein the diffusing lens has a textured surface.

* * * * *